US012680209B2

(12) United States Patent
Debuf et al.

(10) Patent No.: US 12,680,209 B2
(45) Date of Patent: Jul. 14, 2026

(54) METHOD FOR MONITORING THE TENSION OF A PILE YARN IN A TUFTING MACHINE AND MONITORING SYSTEM

(71) Applicant: VANDEWIELE NV, Kortrijk/Marke (BE)

(72) Inventors: Geert Debuf, Drongen (BE); Marco Arlone, Pray (IT); Giacomo Dalle Nogare, Pettinengo (IT); Carlo Milanaccio, Sagliano Micca (IT)

(73) Assignee: VANDEWIELE NV, Kortrijk/Marke (BE)

( * ) Notice: Subject to any disclaimer, the term of this patent is extended or adjusted under 35 U.S.C. 154(b) by 0 days.

(21) Appl. No.: 19/249,481

(22) Filed: Jun. 25, 2025

(65) Prior Publication Data

US 2026/0062846 A1 Mar. 5, 2026

Related U.S. Application Data

(63) Continuation of application No. PCT/IB2024/053747, filed on Apr. 17, 2024.

(30) Foreign Application Priority Data

Apr. 17, 2023 (BE) ..... 2023/5287

(51) Int. Cl.
*D05C 15/18* (2006.01)
*D05C 15/20* (2006.01)

(52) U.S. Cl.
CPC ..... *D05C 15/18* (2013.01); *D05C 15/20* (2013.01)

(58) Field of Classification Search
CPC ..... D05C 15/04; D05C 15/16; D05C 15/18; D05C 15/26; D05C 15/32; D05C 5/02; D05C 5/04; D05C 13/02
See application file for complete search history.

(56) References Cited

U.S. PATENT DOCUMENTS 3,994,245 A * 11/1976 Smith ..... D05C 15/18 200/61.18
4,078,505 A * 3/1978 Fitton ..... D05C 15/18 200/61.18

(Continued)

FOREIGN PATENT DOCUMENTS

| | | |
|---|---|---|
| CN | 102517812 A | 6/2012 |
| GB | 1577313 A | 10/1980 |
| GB | 2569403 A | 6/2019 |

OTHER PUBLICATIONS

International Search Report and Written Opinion for International Application No. PCT/IB2024/053747, Mailing date of Jun. 25, 2024.

*Primary Examiner* — Danny Worrell
(74) *Attorney, Agent, or Firm* — FRESH IP PLC; Clifford D. Hyra; Aubrey Y. Chen

(57) ABSTRACT

Disclosed herein is a method and associated monitoring system for monitoring the tension of a pile yarn in a tufting machine which is provided with several tufting needles and assumes cyclically successive machine positions during various machine cycles, where this pile yarn (3) is incorporated in a fabric in the machine cycles by means of a tufting needle which is positioned in various needle positions at a respective distance from the fabric (7) by positioning the tufting machine in the machine positions during each machine cycle. The method includes generating measurement signals ($D_v$) by means of a motion sensor which are an indication of the pile yarn consumption of this pile yarn, determining machine position data ($D_m$) which are an indication of one or more machine positions per machine cycle and evaluating the measurement signals ($D_v$) on the basis of the machine position data ($D_m$).

27 Claims, 5 Drawing Sheets

(56) References Cited

U.S. PATENT DOCUMENTS

| | | | | | |
|---|---|---|---|---|---|
| 4,267,787 | A | * | 5/1981 | Fukuda | D05C 15/14 112/272 |
| 5,662,054 | A | * | 9/1997 | Bardsley | D05C 15/18 112/470.01 |
| 5,979,344 | A | * | 11/1999 | Christman, Jr. | D05C 15/28 112/80.23 |
| 8,225,727 | B2 | * | 7/2012 | Wilson | D05C 15/24 112/80.71 |
| 9,657,419 | B2 | * | 5/2017 | Hall | D05C 15/22 |
| 2020/0087103 | A1 | | 3/2020 | Mccomas | |

* cited by examiner

METHOD FOR MONITORING THE TENSION OF A PILE YARN IN A TUFTING MACHINE AND MONITORING SYSTEM

This application claims priority to International Application No. PCT/IB2024/053747, which claims the benefit of Belgium Patent Application No. BE2023/5287 filed on Apr. 17, 2023, each of which is hereby incorporated by reference in its entirety.

FIELD OF THE DISCLOSURE

The present disclosure relates to a method for monitoring the tension of a pile yarn in a tufting machine which is provided with several tufting needles and assumes cyclically successive machine positions during various machine cycles, wherein this pile yarn is incorporated in a fabric in the machine cycles by means of a tufting needle which is positioned in various needle positions at a respective distance from the fabric by positioning the tufting machine in said machine positions during each machine cycle, comprising generating measurement signals by means of a motion sensor which are an indication of the pile yarn consumption of this pile yarn. In addition, the present disclosure relates to a monitoring system for monitoring the tension of a pile yarn.

BACKGROUND

For each said machine cycle, a tufting needle may or may not be inserted in the fabric (backing or substrate) in order thus to form or not form pile by means of the pile yarn. A tufting machine is provided with several tufting needles and several corresponding pile yarns are fed to the tufting machine in order to form a tufted fabric therewith. To this end, the tufting needles are typically arranged on a needle bar which is moved up and down during such a machine cycle. In this case, the tufting needles may be selected individually (individual needle selection) in order to follow or not follow the movement of the needle bar so as to insert or not insert the former into the fabric.

A specific position of a tufting needle during a machine cycle which is the result of the up and down movement of the needle bar, at a certain distance from the fabric, thus a position in the vertical direction, is referred to as a needle position. During one machine cycle, the tufting needle is in all needle positions between the upper position of the tufting needle and the lower position of the tufting needle twice, once during the upward movement and once during the downward movement.

When the tufting needle has been selected not to follow the movement of the needle bar during a machine cycle, the needle position of this tufting needle remains unchanged during this machine cycle, since the upward and downward movement of the needle bar is not followed. A machine cycle is a cyclic sequence of machine positions.

Traditionally, a machine cycle is divided into 360 degrees, analogous with the angular position of the axle used to drive the tufting machine. Alternatively, it is possible to opt for another division between predefined limit values.

Systems and methods for monitoring the tension of a pile yarn are in this case intended to be able to stop the tufting machine as quickly as possible in case of an increase in the tension and/or in case of breakage of a pile yarn. In case of an increase in tension, it is desirable to be able to stop the tufting machine before the pile yarn breaks. In addition, the tension of the pile yarns to be monitored has a significant effect on the quality of a fabric tufted using the former, such as for example a tufted carpet.

WO2017/006226A1 describes a detection system and an associated method for monitoring the tension of a pile yarn in a textile machine, such as for example a tufting machine, using the individual actuators which are each provided for supplying a corresponding pile yarn. However, with the monitoring system described therein, it is only possible to intervene in the case of deviating tensions after a considerable number of machine cycles have been performed. With tufting machines comprising motors for simultaneously supplying different pile yarns, the solution from WO2017/006226A1 can therefore not be used.

GB 2 113 404 A describes a detection system and an associated method for monitoring the tension of a yarn in a textile machine, and more specifically a tufting machine, using sensors which generate measurement values which are a measure for the tension of the yarn, more specifically the pile yarn. At least one signal is generated per machine cycle. Measurement values of at least one machine cycle determined in this way are compared to the same reference values (such as a high and a low reference value) and an error signal is generated when the difference between these measurement values and the reference values deviates from a specific value. Error signals are usually only generated after several machine cycles.

EP 3 165 490 A1 describes a detection system and an associated method for monitoring the tension of a yarn in a sewing machine using a piezoelectric sensor in the form of a rectangular plate which also generates measurement values which are a measure for the tension of the yarn. This system could possibly be used with tufting machines, but in practice this is a rather laborious undertaking. Tufting machines require a very large number of pile yarns. This system is not compact, takes up a considerable amount of space and requires various components for it to operate. After all, the yarn tension is being converted into a mechanical force on an object (e.g. a cylinder) and this object in turn transmits the mechanical force onto a force-receiving component, following which a tension is generated in the piezoelectric sensor.

The Applicant of EP 3 165 490 A1, Eltex has introduced a detection system Eltex Eye onto the market which is specifically adapted to tufting machines, using another type of piezoelectric sensor which detects the movement. In this case as well, action can only be taken after a considerable number of machine cycles. In addition, sensor control only starts when the machine is at operating speed. There is thus no detection while the machine accelerates or decelerates.

US 2020/0087103 A1 describes a detection system and an associated method for monitoring the tension of a yarn in a textile machine, such as for example a tufting machine, using optical sensors which measure the speed of the yarn. Here too, the machine only stops when the sensor indicates the absence of a yarn movement for a sufficiently long time. Here too, sensor control only starts when the machine is at operating speed.

With the current systems, the machine does not stop every time a pile yarn becomes dislodged from a tufting needle either. The sensor which is situated above the needle still detects a yarn movement, since the feeding system still supplies pile yarn at a correct speed. This pile yarn passes through the sensor, as a result of which detection of an error does not take place sufficiently quickly.

There is therefore a need for an improved detection system for tufting machines which can be used with different kinds of tufting machines and by means of which it is possible to act more quickly when an error is detected.

SUMMARY

One object of the disclosure is achieved in the first place by providing a method for monitoring the tension of a pile yarn in a tufting machine which is provided with several tufting needles and assumes cyclically successive machine positions, wherein this pile yarn is incorporated in a fabric in the machine cycles by means of a tufting needle which is positioned in various needle positions at a respective distance from the fabric by positioning the tufting machine in said machine positions during each machine cycle, comprising:

- generating measurement signals by means of a motion sensor which are an indication of the pile yarn consumption of this pile yarn;
- determining machine position data which are an indication of one or more machine positions per machine cycle; and
- evaluating the measurement signals on the basis of the machine position data.

Due to the fact that the measurement signals are compared to the corresponding machine position, it is possible to analyze the behavior of the yarn movement within one machine cycle, thus making it possible to obtain a quicker analysis of any yarn errors. In this way, it is for example possible to detect quickly whether the pile yarn has become dislodged from the tufting needle. With the existing systems, the delay until the problem is detected is so long, that several machine cycles are performed without a notification.

It is now also possible to detect errors or deviations during acceleration or deceleration of a tufting machine.

Some tufting machines have a varying pile yarn consumption due to their operational principle, which may vary with each machine cycle. With a method according to the present disclosure, a detection of individual pile points is now possible with these tufting machines, in this case the absence of pile may be omitted completely. Such a detection is not possible with existing systems, as there is no analysis for each machine cycle which takes into account the specific machine positions which are associated with the generated measurement signals. As a result thereof, desired sudden changes in pile yarn consumption, resulting from individual needle selection or varying pile yarn supply, are difficult to detect in existing systems.

By means of the method according to the present disclosure, it is now also possible to detect yarn breakage (BED or "Broken End Detection") quickly and correctly. Yarn breakage (BED) does not only cover the detection of actual broken pile yarn, but also the detection of instances where the tension of the pile yarn is much too low. Increases in the tension of the pile yarn (TED or "Tight End Detection") can also be detected before yarn breakage occurs. By detecting undesired changes in yarn tension in a timely manner, it is also possible to ensure a more uniform quality of the tufted fabric.

Depending on the type of error or deviation which is detected, an alarm may be generated or the tufting machine may be stopped.

The machine position data can be determined in various ways.

Thus, it is possible to determine the machine position data quasi continuously in order to evaluate the measurement signals on the basis thereof, with limited or no interpolation. Alternatively, it is for example possible to determine the machine position using one pulse per machine cycle or using different discrete pulses per machine cycle and to make up the other machine positions on the basis thereof via interpolation.

A method according to the present disclosure is preferably used with each individual pile yarn which is incorporated using a corresponding tufting needle in the tufting machine. For each individual pile yarn, an individual said motion sensor is then provided.

When the pile yarn is incorporated in the fabric according to a predetermined desired pile pattern, it is possible, with a specific method according to the present disclosure, to forward this pile pattern in the tufting machine at at least one fixed moment per machine cycle to various components of the tufting machine which use the pile pattern. In this case, the pile pattern may also be forwarded to the motion sensor and/or to a unit for determining the machine position data which forms part, for example, of a control unit. The machine position data may then at least partly be determined by means of the moment the pile pattern was forwarded.

Still more specifically, it is then possible to determine, on the basis of the pile pattern for each machine cycle, at which pile height the pile yarn is incorporated in the fabric. The measurement signals can then be evaluated on the basis of this pile height. In this way, it is not only possible to take into account during detection whether or not pile is expected, but also which amount of pile yarn is to be supplied to this end. The detected pile yarn consumption can then be compared more accurately to the expected pile yarn consumption in order to thus detect errors.

With a tufting machine, a varying pile yarn consumption occurs when a tufted fabric having different pile heights is being produced. Examples thereof are, inter alia:

- tufting machines comprising a system with several pile-feeding rollers with different yarns and/or yarn colours or which each rotate at a different and/or varying speed and thus produce different (discrete) pile heights, as a result of which the yarns and colours are or are not visually visible in the carpet and form a pattern (design). For example, the multi-roll attachment (MRA) is known in the market.
- tufting machines comprising individual pile delivery (e.g. Myriad, Infinity, iTuft individual tuft). Depending on the machine, several and up to an unlimited number of pile heights can be formed in this case.

A varying pile yarn consumption also occurs in the following cases, inter alia:

- with tufting machines having individual needle selection (e.g. Colortec). With this type of machine, the tufting needle can be selected to optionally follow the movement of the needle bar. If a tufting needle is not selected, only a minimal pile yarn consumption of the corresponding pile yarn remains.
- when strips of carpet are designed not to be provided with pile.

Determining whether or not pile is being formed with a certain pile yarn during a machine cycle and taking this into account when evaluating the measurement signals, is possible on the basis of the pile pattern and/or on the basis of the knowledge whether the corresponding tufting needle is or is not selected, i.e. the corresponding needle selection data.

If it is possible to select the tufting needle for each machine cycle to be positioned in various needle positions, optionally in accordance with the various machine positions, needle selection data may be determined in a particular method according to the present disclosure, which indicate for each machine cycle whether the tufting needle has or has not been selected in order to be positioned in various needle positions by the various machine positions. The measurement signals can then be evaluated on the basis of these needle selection data.

A detection of yarn breakage (BED) should not result in an incorrect error message in case of minimal pile yarn consumption. By taking into account the needle selection data and/or the pile pattern, such incorrect error messages can be minimized.

If the pile height is fixed across the entire width of the tufting machine, as is often the case for example when producing types of artificial turf, the chosen pile height may be determined, for example, by means of the value for the speed of the pile-feeding rollers which together supply all pile yarns in the tufting machine.

In a specific embodiment of a method according to the present disclosure, the measurement signals for each machine cycle are evaluated on the basis of the machine position data both in a first mode and in a second mode. If desired, the measurement signals may in this case also be evaluated in more than two modes for each machine cycle. In this way, it is possible to detect various issues in one machine cycle, depending on what one wants to detect. Thus, it is possible, for example, to detect both undesired increased tensions of the pile yarn (TED) and yarn breakage of the pile yarn (BED) in one machine cycle. These detections may be performed in specific zones of the machine positions.

In a further embodiment of a method according to the present disclosure, a statistical distribution of measurement signals per machine position is determined on the basis of these measurement signals over several machine cycles.

By means of this statistical distribution, the needle cycle of a tufting needle with a specific pile yarn arranged therein can be determined specifically by means of the measurement signals using the corresponding motion sensor. The probability with which the motion sensor determines a yarn movement normally virtually corresponds to a typical needle movement. This provides information about the presence of pile yarn in this motion sensor. When the measurement signals indicate the absence of a pile yarn movement, i.e. that there is no pile yarn consumption, it is possible to check whether this pile yarn should or should not move. In zones of a carpet where no tufting takes place, the motion sensor can be used to detect whether pile yarn consumption of a pile yarn suddenly occurs where this is not desired.

In a method according to the present disclosure, the motion sensor may take various forms. Thus, it is for example possible, analogous to US 2020/0087103 A1, to choose an optical sensor as said motion sensor. Alternatively, it is for example possible, analogous to an Eltex Eye, to choose a piezoelectric sensor as said motion sensor.

The measurement signals are generated at a specific sensor sensitivity, as a result of which the resultant measurement signals are influenced in order to obtain, depending on boundary conditions, such as machine speed or type of pile yarn used, relevant measurement signals. With a relatively slow machine, for example, a motion sensor detects less yarn movement than is the case with a relatively quick machine during the same time interval. By using a different sensor sensitivity in both situations, in each case similar relevant measurement signals are obtained which correctly indicate whether or not there is yarn movement in both situations. In this way, the generated measurement signals are a clear and unambiguous indication for the pile yarn consumption and may be evaluated without taking into account the influence of boundary conditions and ambient influences.

The sensor sensitivity is an indication of the degree to which the motion sensor is responsive to movement. The sensor sensitivity thus determines how suitable the sensor-generated measurement signals are to be used to indicate movement (or pile yarn consumption). The movement to be detected is the movement of the pile yarn which follows the known needle movement of the tufting machine. As a result thereof, the adjustment of the sensor sensitivity can also be used to obtain measurement signals which detect the expected movement of the needle, irrespective of the boundary conditions and the ambient influences, such as e.g. vibrations.

The sensor sensitivity is consequently a scale factor by which raw data, measured by the sensor, are multiplied in order thus to obtain measurement signals which can be evaluated without taking into account the influence of boundary conditions and ambient influences.

This sensor sensitivity is then preferably adjustable.

More specifically, this sensor sensitivity may in this case be configured to be automatically adjustable, so that this sensor sensitivity does not always have to be adjusted manually.

In the following specific embodiments in which the sensor sensitivity is adjusted, the sensor sensitivity may be adjusted either manually or automatically.

In the prior art, the sensor sensitivity may be adjustable, but this is then the case for either all motion sensors which are used in a tufting machine for monitoring the tension of a pile yarn or for a group of motion sensors which are used in a specific zone of the tufting machine. If, in existing systems, there are too many false detections, for example when two greatly differing pile yarns are being incorporated in a fabric next to each other, the detection has to be supplemented with a visual inspection by people.

In a method according to the present disclosure, this sensor sensitivity is preferably individually adjustable for each motion sensor, so that the measurement signals can be more reliable for different kinds of pile yarns and in different circumstances, such as forming or not forming pile, the needle bar position of a sliding needle bar, the pile height, a variable supply motor speed, a variable machine speed, an acceleration or a deceleration of the machine speed, etc. Such an individual adjustability is not only advantageous with a method according to the present disclosure, but may also provide significant advantages with known tufting machines, independently from the evaluation of measurement signals on the basis of machine position data.

More specifically, in order to determine the specific sensor sensitivity for a pile yarn used in the tufting machine, a statistical distribution of the measurement signals per machine position may be determined. In a learning cycle over various machine cycles, the sensor sensitivity may be adjusted until the specific statistical distribution virtually corresponds to the typical needle movement over a machine cycle. A typical needle movement means that little to no yarn movement is detected in TDC (Top Dead Centre—the moment at which the tufting needle is situated at its highest point) and BDC (Bottom Dead Centre—the moment at which the tufting needle (12) is situated at its lowest point) and maximum movement halfway between TDC and BDC.

In a said learning cycle, it is possible to (automatically) determine which is the optimum sensor sensitivity for each individual pile yarn. During such a learning cycle, the sensor sensitivity can easily be individually adjusted for each pile yarn, depending on the yarn type and/or depending on machine speed and/or depending on the desired type of detections, such as for example BED or TED.

In a further specific embodiment, if, after the learning cycle, the specific statistical distribution deviates from the typical needle movement, above a set upper limit value or below a set lower limit value, it is possible to adjust the specific sensor sensitivity accordingly until the specific statistical distribution again virtually corresponds to the typical needle movement. A said upper limit value and/or a said lower limit value is preferably determined as a percentage deviation.

With a method according to the disclosure, the sensor sensitivity may be configured to be adjustable on the basis of one or more factors. Thus, this sensor sensitivity may be configured to be adjustable on the basis of the following:

- needle selection data; and/or
- needle bar position data which are determined if the tufting machine comprises a sliding needle bar (sliding needle bar); and/or
- the pile height (more sensitive if there is less pile than when there is more pile);
- a variable supply motor speed at which the pile yarn in the tufting machine is supplied by means of a supply motor, which ensures an adjustment on the basis of the pile delivery per machine cycle; and/or
- a variable machine speed at which the tufting machine is driven; and/or
- an acceleration or a deceleration of the machine speed by means of which the tufting machine is controlled; and/or
- the type of pile yarn;
- the type of detection.

In case a sliding needle bar is used, the angle of the pile yarn with respect to the motion sensor differs in accordance with the position of the needle bar, resulting in a varying sensor signal depending on the displacement of the tufting needle with respect to the motion sensor. By adjusting the sensor sensitivity on the basis of the needle bar position data, the sensor sensitivity is thus adjusted while taking into account the angle which the pile yarn in the motion sensor makes.

During processing of the pile yarn in each machine cycle, there is a zone in which there is little, if any, movement of the pile yarn. In a further embodiment, the measurement signals in these zones can be evaluated and an error signal may be generated if the measurement signals indicate a certain pile yarn consumption during a monitoring time. In this case, the sensor sensitivity is preferably also adjusted in accordance with said zones.

In this way, increased tensions of the pile yarn can be detected with an accuracy which is similar to that with which yarn breakage can be detected. Before a pile yarn breaks, the quality of the tufted fabric has already been decreasing for a prolonged period of time due to the increase in the tension of the pile yarn. Thus, carpet of lower quality may be produced for a long period of time before a pile yarn actually breaks.

By using piezoelectric sensors as motion sensors, the measurement signals in this situation then already provide an active signal across a wider machine position. This zone becomes wider as the yarn tension increases due to the increasing friction of the pile yarn in the sensor. Ultimately, the motion sensor produces a signal at machine positions where no movement is expected, due to the continuous friction of the pile yarn in the sensor.

As an alternative or in addition to generating an error signal when the measurement signals indicate a certain pile yarn consumption during a monitoring time in zones where no movement of the pile yarn is expected, an error signal may be generated if the measurement signals indicate a certain pile yarn consumption during a monitoring time which is longer than a machine cycle. The reason for this is that movements across zones which are so wide that they no longer correspond to the repeating needle movement also indicate an undesired increase in the tension of the pile yarn.

If the motion sensors are optical sensors, the undesired increase in the yarn tension of a pile yarn results in the detection of less movement of the pile yarn. Ultimately, the motion sensor indicates a greatly reduced movement in zones where movement is expected. In this way, such undesired increases in the yarn tension can be detected (TED detection).

In order to apply a method according to the present disclosure, the pile yarn consumption of the pile yarn is preferably measured by means of the motion sensor between a feeding device for supplying the pile yarn in the tufting machine and the tufting needle.

Alternatively, but less preferred, the pile yarn consumption of the pile yarn may also be measured between a yarn storage system and a feeding device for supplying this pile yarn from the yarn storage system in the tufting machine. At this location, fewer detections or less accurate detections may be performed. However, due to lack of space, it is not always possible to provide a motion sensor at a location between the feeding device and the tufting needle in tufting machines. In such cases, it is still possible to perform more and/or more accurate detections using a method according to the present disclosure with a motion sensor between the yarn storage system and the feeding device than with prior-art monitoring systems.

In a further specific embodiment, a moving average of the measurement signals is determined over a specific number of machine cycles, and it is determined whether this moving average exceeds a first limit value. An increase in the moving average is typically a precursor of yarn breakage. Additionally (or alternatively), it may be determined whether the moving average drops below a second limit value.

In this case, the moving average may be a so-called simple moving average. Alternatively, this moving average may, for example, be a centered (cumulative) moving average, or a weighted moving average, or an exponential moving average.

In this case, a said limit value is preferably determined as a percentage deviation. Thus, the first limit value may, for example, be a deviation of 10%, in which case it is then determined whether the moving average has increased by 10%. Using a percentage deviation makes it simple to take into account differences, such as for example a difference in pile yarn. Alternatively, but less preferred, an absolute number may be chosen as limit value.

Preferably, this specific number of machine cycles is adjustable and/or the limit value(s) is/are configured to be adjustable.

By evaluating this moving average in comparison with the limit values, it is possible to verify when the tension becomes excessively high with the risk of yarn breakage or loss of quality or when this tension becomes excessively low with the risk of loss of quality.

An increasing yarn tension results in an increase in this moving average. A decreasing yarn tension results in a decrease in this moving average.

In this way, it is also possible to detect increased and reduced tensions of the pile yarn with an accuracy similar to that with which yarn breakage can be detected.

If the moving average exceeds the first limit value and/or drops below the second limit value, an alarm may be generated and/or the tufting machine may be stopped.

If desired, several limit values may be provided in case of an increase in the moving average and several limit values may be provided in case of a decrease in the moving average. Thus, it is possible, for example, for an alarm to be generated when the moving average increases above the first limit value and for the tufting machine to be stopped above a third limit value, which is higher than the first limit value. Analogously, it is possible to generate an alarm if the moving average drops below the second limit value, and for the tufting machine to be stopped below a fourth limit value, which is lower than the second limit value.

In addition, various possible limit values may also be provided for various possible detections.

In yet another embodiment of a method according to the present disclosure, the tension of one or more additional pile yarns is monitored by generating, by means of one or more corresponding additional motion sensors, corresponding additional measurement signals and evaluating these additional measurement signals on the basis of the machine position data.

In this case, a statistical distribution of the measurement signals of several motion sensors is then preferably also determined. By means of a statistical distribution of the measurement signals of several motion sensors, information is obtained regarding the movement of the needle bar as a whole. On the basis of this information, it is possible to check the correct adjustment of the needle movement. In addition, information about the profile and the timing of the pile yarn consumption is also obtained.

Preferably, a moving average of the corresponding measurement signals over a specific time period is determined for each monitored pile yarn and it is preferably determined whether this moving average exceeds a first limit value and/or drops below a second limit value.

In this case, the first limit value and/or the second limit value may optionally be chosen different from each motion sensor or different from each group of motion sensors, for example in order to take into account various types of pile yarn which are incorporated in the same fabric. By using a percentage deviation as a limit value, it is easier to take differences into account.

Adjustment is also easier. The user can define the maximum permissible percentage deviation for all yarns, but due to the fact that the deviation is a percentage deviation, the actual limit value may still be different for every pile yarn.

Analogously to the above, it is optionally also possible to provide several limit values in case of an increase in the moving average and several limit values in case of a decrease in the moving average. Analogously, the required alarms may also be generated and/or the tufting machine may be stopped.

In addition, one object of the present disclosure is also achieved by providing a monitoring system for monitoring the tension of a pile yarn in a tufting machine which is provided with several tufting needles and assumes cyclically successive machine positions in various machine cycles, wherein this pile yarn is incorporated in a fabric in the machine cycles by means of a tufting needle which is positioned in various needle positions at a respective distance from the fabric by positioning the tufting machine in said machine positions during each machine cycle, comprising a motion sensor for generating measurement signals which are an indication of the pile yarn consumption of this pile yarn, a unit for determining machine position data which are an indication of one or more machine positions per machine cycle and an evaluation system for evaluating the measurement signals on the basis of the machine position data.

One object of the present disclosure is furthermore also achieved by providing a tufting machine comprising such a monitoring system.

BRIEF DESCRIPTION OF THE DRAWINGS

The present invention will now be explained in more detail by means of the following detailed description of a few embodiments of tufting machines, monitoring systems and methods according to the present invention. The sole aim of this description is to give illustrative examples and to indicate further advantages and particulars of at least one embodiment of the present invention, and can therefore not be interpreted as a limitation of the area of application of the invention or of the patent rights defined in the claims.

Reference numerals are used in this description to refer to the attached drawings, in which.

DETAILED DESCRIPTION

Figure 1:
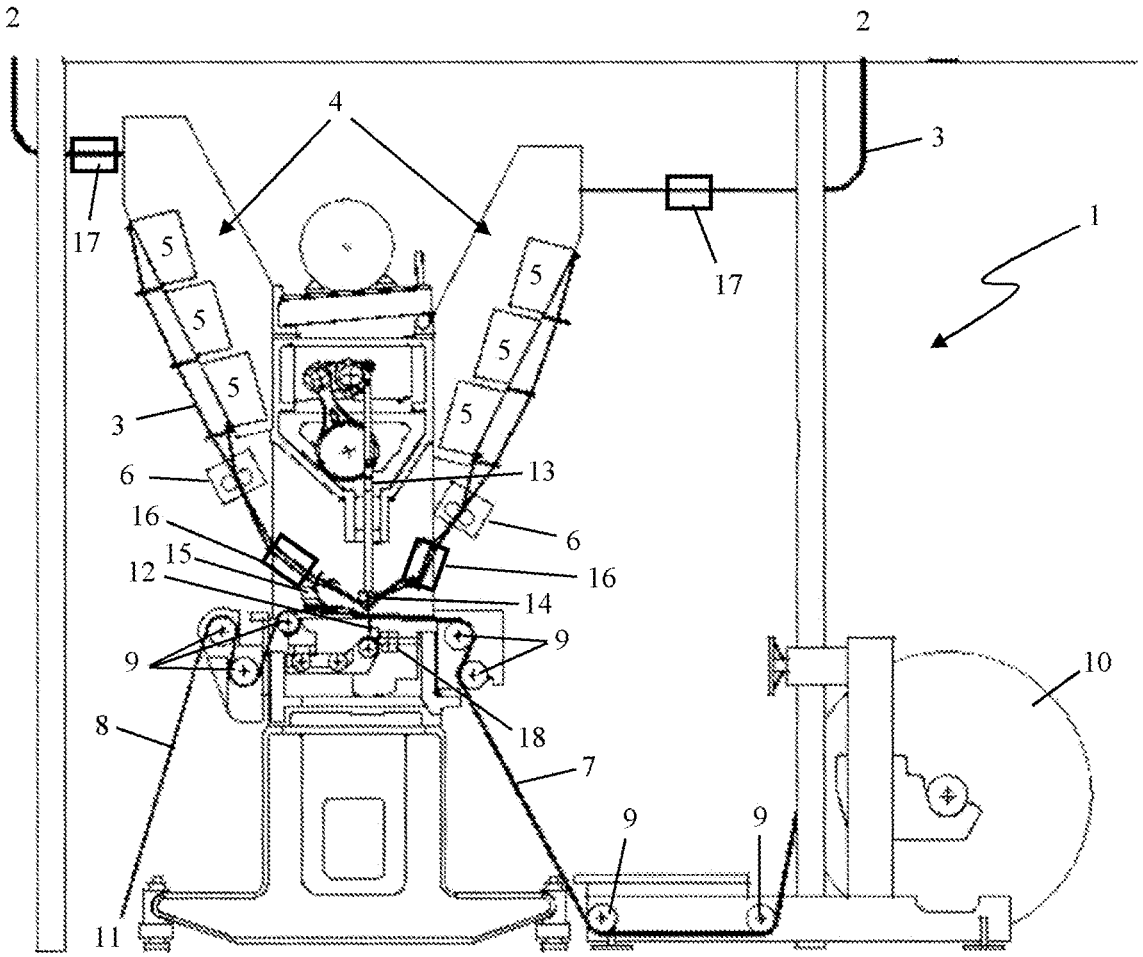
FIG. 1 diagrammatically shows a tufting machine according to at least one embodiment of the present invention.

In the tufting machine (1) illustrated in FIG. 1, pile yarns (3) are supplied from a yarn storage system (creel) (2) (not shown) to the tufting machine (1) by means of a feeding device (4). To this end, the feeding device (4) comprises several yarn feed modules (5) which are, for example, provided with an individual supply per pile yarn (3) by providing an actuator-driven drive roller and a guide roller for each pile yarn (3). In addition, puller rolls (6) are also provided.

By means of the yarn feed modules (5) and puller rolls (6), the pile yarns (3) are supplied to corresponding tufting needles (12).

The puller rolls (6) consist of a pair of rods between the feeding device (4) and the tufting needles (12) through which all pile yarns (3) pass. These puller rolls (6) are arranged in such a manner that they lightly touch each of the pile yarns (3), so that the tension of the pile yarns (3) in the tufting machine (1) is equalized, as the pile yarns (3) are being supplied from different heights and at different speeds.

The tufting needles (12) are arranged on a needle bar (14) which is movable up and down in the tufting machine (1) by means of one or more connecting rods (13). By moving the tufting needles (12) up and down, the corresponding pile yarns (3) are introduced into a fabric (backing or substrate) (7) in order thus to produce a tufted fabric (8).

To this end, the fabric (7) is passed from unwinders (10) under the tufting needles (12) by means of cloth feed rollers (9) and rolled back up onto winders (11). To this end, one or more cloth feed rollers (9) are driven rollers, while the other cloth feed rollers (9) are designed as guide rollers.

The fabric (7) is clamped at the location of the tufting needles (12) by means of a presser foot (15). Furthermore, bed plate mechanisms (18) are present which may comprise grippers for forming loop piles and optionally knives for cutting the loop piles in order thus to form cut piles.

This construction of tufting machines (1) is known and may be configured in various ways and in various variants, so that this will not be discussed in any more detail in the context of the present patent application. In the case of tufting machines (1) with individual pile delivery, for example, the puller rolls (6) will not be present.

According to the disclosure, each pile yarn (3) of such a tufting machine (1) is now provided with a corresponding motion sensor (16, 17). This motion sensor (16, 17) may be fitted at various positions in the line of the movement of the corresponding pile yarn (3). In a first illustrated position, the motion sensor (16) is arranged between the feeding device (4) and the tufting needle (12). In a second illustrated position, the motion sensor (17) is arranged between the yarn storage system (2) and the feeding device (4). Several such motion sensors (16, 17) may be fitted at each said position in the same housing in order to install these more easily in the tufting machine (1) as a group. Thus, for example, a housing comprising 16 such sensors (16, 17) may be provided.

In the installed position in the tufting machine (1), these motion sensors (16, 17) are provided in order to generate measurement signals ($D_v$) which are an indication of the pile yarn consumption for each supplied pile yarn (3).

Various kinds of motion sensors (16, 17) may be taken into consideration for this purpose, such as for example an optical sensor, analogous to that in US 2020/0087103 A1 or a piezoelectric sensor analogous to that in an Eltex Eye. In the specific embodiments described below, use was made of piezoelectric sensors. These examples also apply mutatis mutandis to other types of motion sensors.

Figure 2:
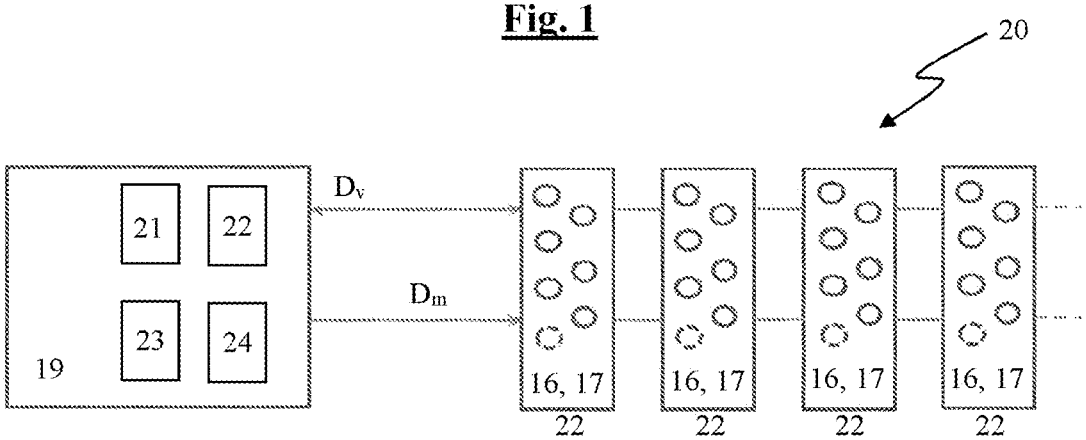
FIG. 2 diagrammatically shows a monitoring system according to at least one embodiment of the present invention.

The monitoring system (20) according to the present disclosure illustrated in FIG. 2 comprises the motion sensors (16, 17) for installation in a tufting machine (1) as illustrated in FIG. 1.

A control unit (19) is provided for controlling this monitoring system (20).

This control unit (19) comprises a unit (24) for determining machine position data ($D_m$). These machine position data ($D_m$) may be determined in various ways.

Thus, it is possible to determine the machine position data ($D_m$) quasi continuously in order to evaluate the measurement signals on the basis thereof, with limited or no interpolation. Alternatively, it is for example possible to determine the machine position using 1 pulse per machine cycle (M) or using various discrete pulses per machine cycle (M) and to make up the other machine positions on the basis thereof via interpolation.

In this case, the machine position data ($D_m$) may indicate the machine positions directly or indirectly, for example by means of the moment of forwarding the change in pattern which is also an indication of the corresponding machine positions.

An evaluation system (22) is provided to evaluate the measurement signals ($D_v$) on the basis of the machine position data ($D_m$). To this end, the machine position data ($D_m$) may be supplied to the evaluation system (22) via a separate position channel or may alternatively, for example, be integrated in forwarded fieldbus process data.

The evaluation system (22) will typically be distributed across the various motion sensors (16, 17) which are each separately or per group (for example per group of 2, 4, 8 or 16) provided with a local part of the evaluation system (22) for evaluating the measurement signals ($D_v$) on the basis of the machine position data ($D_m$). In housings comprising 16 of said motion sensors (16, 17), these motion sensors (16, 17) may, for example, be controlled all together or divided up into various blocks (of 2, 4, 8 or 16) by a local control unit which is in turn controlled by means of the control unit (19). The various motion sensors (16, 17) in one block may in this case be scanned one by one in each case and the resulting measurement signals ($D_v$) may be compared to the value on a comparator in the local part of the evaluation system (22). The sensor sensitivity corresponding to the motion sensor (16, 17) to be scanned (and optionally also corresponding to the detection zone, if a difference is made in sensitivity in two different detection zones of one machine cycle) may in this case be filled in.

If desired, the control unit (19) (for example designed as a microprocessor) may additionally be provided with a central part of the evaluation system (22) (implemented in the microprocessor), for example if the motion sensors (16, 17) generate error signals(S) on the basis of deviations detected during evaluation and the control unit (19) determines whether and which alarm should be generated on the basis of such an error signal(S) and whether the tufting machine (1) is possibly stopped, or if the control unit (19) performs a comparison with the pile pattern in order to evaluate the measurement signals ($D_v$), etc. Alternatively, it would also be possible to have the measurement signals ($D_v$) be read in by the control unit (19) and for the evaluation system (22) to completely form part of the control unit (19).

By distributing the evaluation system (22) across local parts for one or more motion sensors (16, 17), only limited information has to be exchanged between these motion sensors (16, 17) and the control unit (19) (microprocessor), as the measurement signals ($D_v$) themselves do not have to be forwarded to the control unit (19). If the measurement signals ($D_v$) were to be forwarded to the control unit (19), more complex evaluations could be implemented in the central part of the evaluation system (22) and/or further statistical processing of measurement signals ($D_v$) could be implemented for a longer period of time and/or of measurement signals ($D_v$) of various motion sensors (16, 17) with respect to each other.

Each of the motion sensors (16, 17) is assigned a separate identification signal which is sent together with the information of this motion sensor (16, 17) to be forwarded, so that it is possible to record where any errors occur.

The monitoring system (20) furthermore comprises an adjusting unit (21) (for example a touchscreen) for adjusting limit values and/or a specific time during which a moving average is to be determined and/or a sensor sensitivity for generating the measurement signals ($D_v$) and/or the type of pile yarn and/or the type of detection, etc.

In addition, the monitoring system (20) may comprise a reading unit (23) for reading in data from the tufting machine (1), such as for example the pile pattern and/or the machine speed at which the tufting machine (1) is driven and/or needle bar position data, etc. In order to read in the data, use may optionally be made of a conventional fieldbus or of a separate position channel. Optionally, but less preferred, the data may also be forwarded wirelessly.

The adjusting unit (21) and/or the reading unit (23) may for example form part of the control unit (19), as is illustrated in FIG. 2.

In this case, the control unit (19) of the monitoring system (20) may be integrated in an existing control unit of the tufting machine (1) which is additionally configured to control the monitoring system (20), both with completely new tufting machines (1) according to the present disclosure and with any existing tufting machines (1) which are modified to become tufting machines (1) according to the present disclosure. The motion sensors (16, 17) are installed on such a tufting machine (1) and the control unit of the tufting machine (1) is coupled to the motion sensors (16, 17) in order to control these motion sensors (16, 17) and to read in signals generated by the motion sensors (16, 17).

Alternatively, it is also possible to configure this control unit (19) completely separate from an existing control unit of a tufting machine (1), as a component of a monitoring system (20) according to the present disclosure, so that a monitoring system (20) according to the present disclosure may also be provided as a separate unit, as a result of which an existing tufting machine (1) can easily be upgraded. It is then for example possible to couple this control unit (19) of the monitoring system (20) to a control unit which is already present in the existing tufting machine (1), for example in order to use a said reading unit (23) to read in data, in order to, for example, be able to adjust the sensor sensitivity on the basis thereof or, for example, to pass on alarms in order to stop the tufting machine (1) on the basis thereof. The motion sensors (16, 17) are then installed on this tufting machine (1) and the control unit (19) of the monitoring system (20) is optionally coupled to the control unit of the tufting machine (1).

FIGS. 3-6 diagrammatically show how the evaluation system (22) is able to take into account movements which can be expected on the basis of the pile pattern when evaluating the measurement signals ($D_v$).

Figure 3:
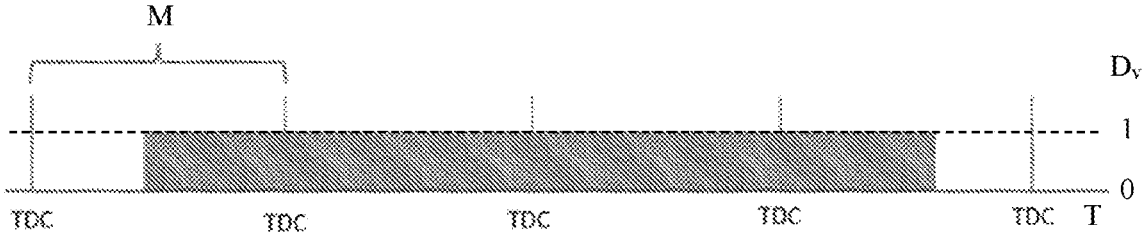
FIG. 3 diagrammatically shows in a graph over various machine cycles (M) how alternately pile is formed in a fabric (7) by means of a pile yarn (3) in some zones and no pile is formed in other zones.
Figure 5:
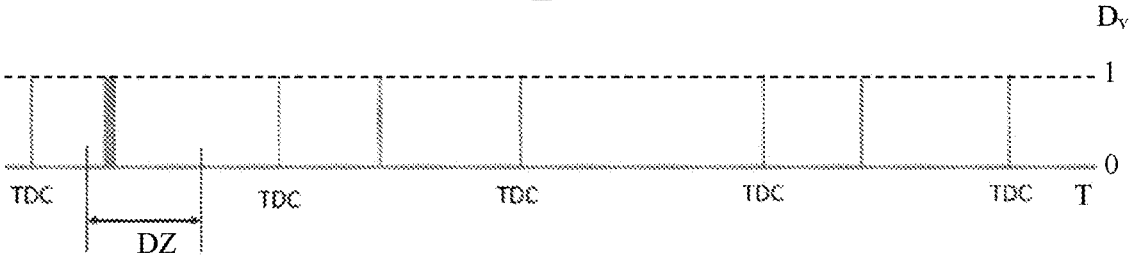
FIG. 5 diagrammatically shows in a graph over various machine cycles (M) how pile is formed in a fabric (7) by means of a pile yarn (3) with varying pile yarn consumption in a more limited number of machine cycles (M), by means of a modified pile yarn consumption, depending on the pile height achieved in the process.

TDC (Top Dead Centre) in FIGS. 3 and 5 always indicates the moment at which the tufting needle (12) is situated at its highest point and is in this case used as a reference for time (T). This moment TDC may be determined as said machine position data ($D_m$), depending on the moment when the pile pattern is forwarded.

FIG. 3 diagrammatically illustrates how, in a fabric (7) in which alternately pile is formed in some zones by means of a pile yarn (3) in a continuous way and in other zones no pile is formed, pile yarn consumption may be detected during various machine cycles (M), while no pile yarn consumption should be detected during various machine cycles (M).

This is diagrammatically illustrated in FIG. 5 with a fabric (7) in which pile is formed with varying pile yarn consumption in a more limited number of machine cycles (M), with a modified pile yarn consumption, depending on the pile height produced in the process. On the basis of the pile pattern, it is possible both to determine the fixed moment per machine cycle (M) at which pile is possibly formed and which pile height and which associated corresponding pile yarn consumption can be expected. Analogously, if the tufting needle (12) for each machine cycle is selectable to be positioned in various needle positions optionally in accordance with the various machine positions, needle selection data may be determined which indicate for each machine cycle (M) whether the tufting needle (12) has or has not been selected to be positioned in various needle positions as a result of the various machine positions. In this way, it is possible to determine where and which pile yarn consumption can be expected. In this case, a detection zone (DZ) may for example intentionally be determined in which corresponding measurement signals ($D_v$) will be evaluated.

Figure 4:
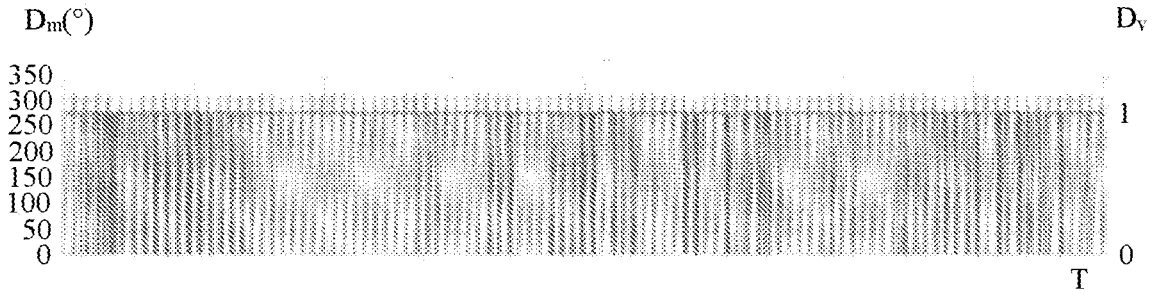
FIG. 4 shows a graph on the basis of the time (T) where, on one side, machine positions ($D_m$) are plotted in degrees and, on the other side, measurement signals ($D_v$) in V are plotted for the pile yarn consumption of pile yarn (3) in a tufting machine (1), in which pile is formed, as is diagrammatically illustrated in FIG. 3.
Figure 6:
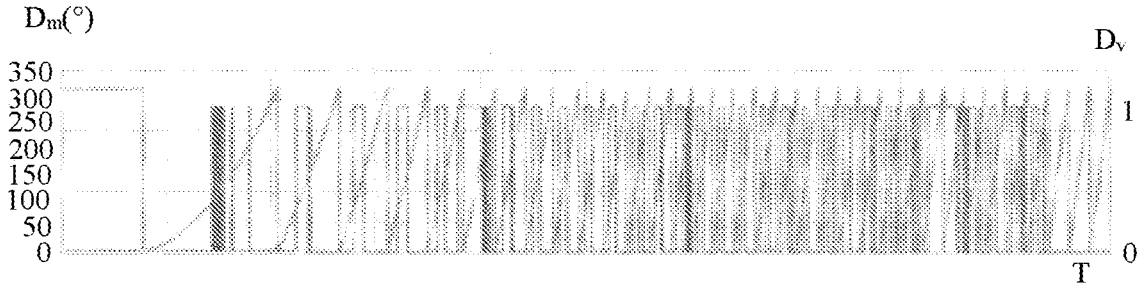
FIG. 6 shows a graph on the basis of time (T) where, on one side, machine positions ($D_m$) are plotted in degrees and, on the other side, measurement signals ($D_v$) in V are plotted for the pile yarn consumption of pile yarn (3) in a tufting machine (1), in which pile is formed, as is diagrammatically illustrated in FIG. 5.

FIGS. 4 and 6 show, on the one hand, actual machine positions ($D_m$) in degrees on the basis of time (T) and, on the other hand, actual measurement signals (Dv) for the pile yarn consumption of pile yarn (3) in a tufting machine (1), in which pile is formed, as is diagrammatically illustrated in FIGS. 3 and 5, respectively. The machine positions ($D_m$) may in this case vary between 0° and 360°. The resultant graph is zigzag-shaped. The measurement signals ($D_v$) are measured by means of a piezoelectric sensor (16) which is placed between the feeding device (4) and the tufting needle (12), and which in this case generates either a measurement value 0, or generates a measurement value 1, with 0 indicating that no movement was detected and 1 indicating that movement was detected. The resulting graph is a square wave.

On the basis of the machine positions ($D_m$), one or more machine positions or machine position zones, such as for example TDC or DZ, may be determined in which the measurement signals ($D_v$) are evaluated.

In this case, a comparison takes place as to whether there is pile yarn consumption where no pile yarn consumption is expected and/or to what degree the pile yarn consumption indicated by these measurement signals ($D_v$) deviates from the pile yarn consumption which may be expected on the basis of the pile pattern. Depending on the type of detected error or deviation, an alarm may be generated or the tufting machine (1) may be stopped. By evaluating the measurement signals ($D_v$) which are an indication of the actual pile yarn consumption on the basis of the pile yarn consumption which is expected on the basis of the pile pattern, it is possible, for example, to prevent an incorrect error message of yarn breakage from being output if the pile yarn consumption is minimal.

Figure 7:
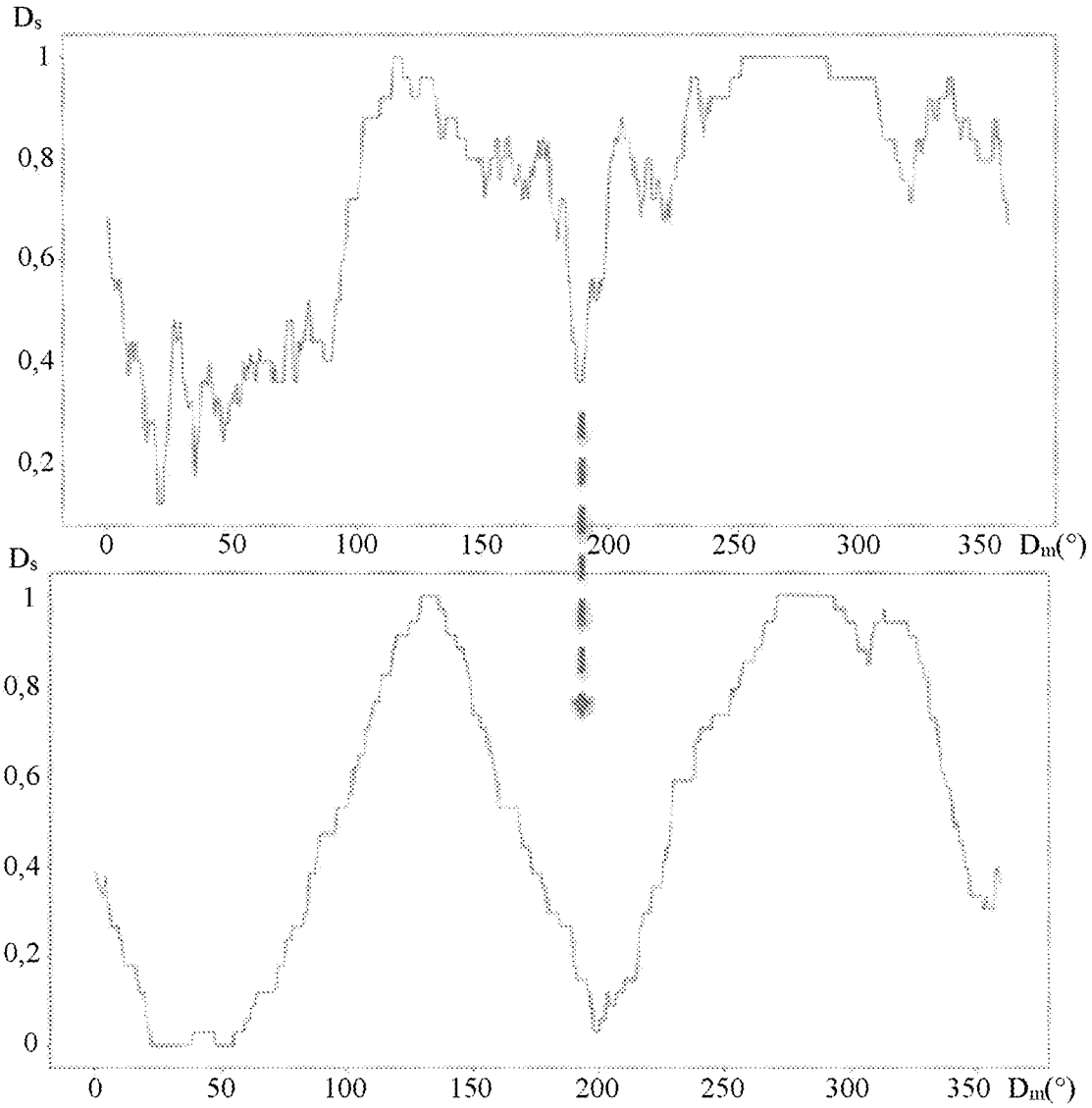
FIG. 7 shows, in two graphs, for each machine position the probability, with a motion sensor which has been placed between the feeding device and the tufting needle determining a yarn movement at different set sensor sensitivities.

FIG. 7 shows, in two graphs, on the basis of the machine positions ($D_m$) in degrees, the probability ($D_s$) (value 0 to 1) averaged over various machine cycles, wherein a motion sensor (16) which has been installed between the feeding device (4) and the tufting needle (12) determines a yarn movement.

With a correctly adjusted sensor sensitivity, this distribution results in the typical reciprocal needle movement of a tufting machine (1), as can be seen in the lower of the two graphs.

If the sensor sensitivity is too high, movements are detected at machine positions in which the needle is stationary. If the sensitivity is too low, the probability of a movement being detected at a high needle speed is too low (e.g. <0.8). If the sensitivity is too high, such a piezoelectric sensor may miss missing pile yarn, and if the sensitivity is too low, the piezoelectric sensor may emit incorrect reports of yarn breakage.

In order to adjust the sensor sensitivity correctly, a learning cycle may be completed. In this case, a first sensor sensitivity may initially be set, wherein the sensor signal at a specific pile delivery is cumulatively placed in a row during several machine cycles per machine position. Within a machine cycle, it is not possible to see the needle movement, but when a sufficient number of machine cycles are averaged out, the distribution will approximate the needle movement. In this way, a statistical distribution of measurement signals ($D_v$) for each machine position is determined during several machine cycles, as can be seen in the top graph.

When this statistical distribution as shown in the top graph still deviates greatly from the typical needle movement, this procedure is repeated. The sensor sensitivity is adjusted and a corresponding statistical distribution ($D_s$) is determined, until this determined statistical distribution ($D_s$) virtually corresponds to the typical needle movement, as is the case in the bottom graph.

After the learning cycle, it is possible to evaluate further to what degree the statistical distribution ($D_s$) remains virtually in agreement with the typical needle movement. If the specific statistical distribution ($D_s$) deviates by more than a set upper limit value from the typical needle movement or deviates by less than a set lower limit value from the typical needle movement, the specific sensor sensitivity may be adjusted accordingly until the specific statistical distribution ($D_s$) again virtually corresponds to the typical needle movement.

Alternatively or additionally, the sensor sensitivity may, in an alternative learning cycle, be adjusted in order to optimize the sensor sensitivity, aiming for a specific percentage detection value of the movement.

This specific percentage detection value which is aimed for is in this case then preferably adjustable.

The percentage detection value is the percentage of the measurement signals which indicates a movement.

The aim is for the motion sensor (16, 17) to detect the yarn movement and to not falsely detect non-yarn movement. Based on the physical knowledge of the tufting process in which the pile yarn (3) is incorporated in the fabric (7), it is known for how long the pile yarn (3) moves during each machine cycle (M). In every machine cycle (M), there is a zone where there is movement in any case which has to be detected, and there is a zone where there is no movement and in which case none should consequently be detected. On the basis thereof, it is also possible to determine what percentage of the measurement signals ($D_v$) should indicate a movement (a certain yarn consumption). This percentage is preferably chosen as the specific percentage detection value which is strived for in said learning cycle. This may be, for example, 30% as specific percentage detection value. If, with a set sensor sensitivity, the percentage detection value deviates greatly from this specific percentage detection value, for example 70% to 80% when the specific percentage detection value has been adjusted to 30%, then it is clear that this sensor sensitivity has not been adjusted correctly. The sensor sensitivity in the alternative learning cycle is then also adjusted until the detected percentage detection value corresponds to the specific percentage detection value.

Such a sensor sensitivity may be determined in this way, in dependence on the type of tufting machine (1) and/or the desired detections, for various types of pile yarn (3) and/or for various types of detections and/or for various pile deliveries and/or pile heights and/or on the basis of needle selection data, etc. Below, some specific examples are discussed in more detail. Further sensor sensitivities may be determined, for example via interpolation, and/or may be worked out more precisely with a self-learning system.

This sensor sensitivity is preferably configured to be adjustable and preferably individually adjustable for each motion sensor (16, 17).

Figure 11:
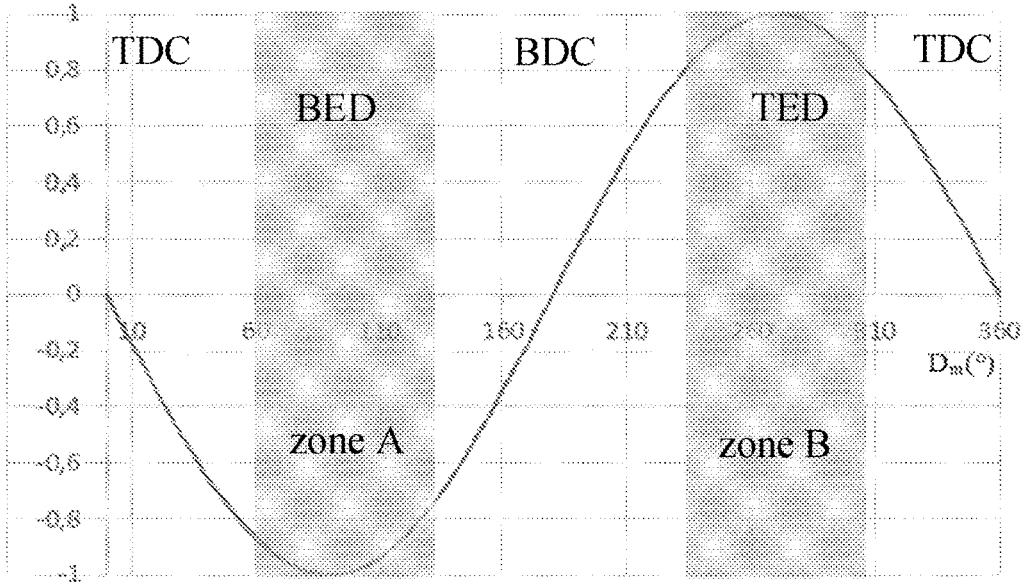
FIG. 11 shows, in a graph, the movement of the tufting needle in a machine cycle on the basis of the needle position, with two zones of detection being indicated.

The sensor sensitivity may, for example, be configured to be automatically adjustable on the basis of a desired detection, such as for example a TED detection or a BED detection. In addition, this makes it possible to determine, for example within a machine cycle (M) on the basis of the known needle movement, where each of these detections can best take place in the machine cycle (M). Thus, a machine cycle (M) can also be divided into different detection zones inside which a different detection may be performed in each case, as is illustrated in FIG. 11, where yarn breakage (BED) is detected in zone A and undesired increased tensions (TED) are detected in zone B. In addition, the sensor sensitivity can in each case be adjusted to be as optimal as possible for these different detection zones. The measurement signals ($D_v$) can thus be evaluated in each machine cycle (M) both in a first way and in a second way on the basis of the machine position data ($D_m$).

A result of the learning cycle for determining an optimum sensor sensitivity and the individual adjustability of this sensor sensitivity is not only that this makes it possible to optimize the sensor sensitivity for each individual pile yarn.

Figure 8:
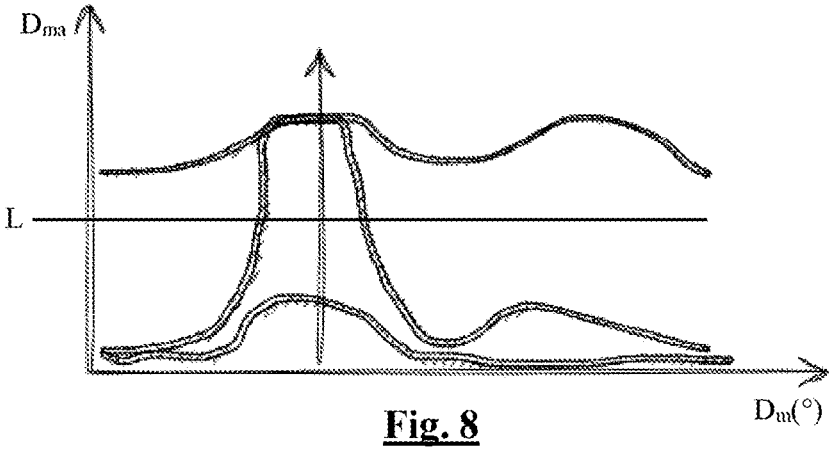
FIG. 8 diagrammatically shows, in a graph, for each machine position the probability, with a motion sensor which has been placed between the feeding device and the tufting needle determining a yarn movement in various situations.
Figure 9:
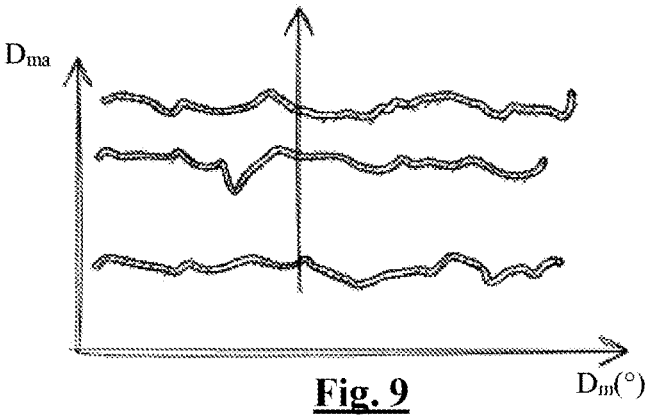
FIG. 9 diagrammatically shows, in a graph, for each machine position the moving average of the measurement signals ($D_v$), with a motion sensor which has been placed between a yarn storage system and a feeding device determining a yarn movement in various situations.

Determining the needle cycle in a motion sensor (16, 17) also provides information about the presence of pile yarn (3) in every motion sensor (16, 17), as is illustrated in FIGS. 8-9. In this way, the wiring of these motion sensors (16, 17) can also be detected.

FIG. 8 diagrammatically shows, in a graph, the probability ($D_s$) for each machine position ($D_m$) in degrees, with values of between 0 and 1 shown, wherein a motion sensor (16) which is arranged between the feeding device (4) and the tufting needle (12) detects a yarn movement in various situations.

In this case, the bottom curve indicates the probability ($D_s$) in case the tufting needle (12) is not threaded with yarn. The middle curve indicates the probability ($D_s$) in case the tufting needle (12) is correctly threaded with yarn and the top curve indicates the probability ($D_s$) when there is an error condition.

In this way, graphs may be produced for various values of the sensor sensitivity of a motion sensor (16). In this case, in each case the probability ($D_s$) is plotted for this sensor sensitivity at which the motion sensor (16) detects yarn movement.

FIG. 8 shows that a threshold value (L) may be defined in this case for which the following holds true:

- If all values of all graphs calculated in this way are below this threshold value (L), then the tufting needle (12) is not correctly threaded with pile yarn (3).
- If the threshold value (L) is exceeded in one or more graphs, then the tufting needle (12) has been threaded correctly.
- If the threshold value (L) is exceeded in all graphs, then there is an error condition, such as for example a motion sensor (16) which is faulty or a pile yarn (3) which is too thick in relation to the sensor, etc.

FIG. 9 shows, in a graph, the moving average ($D_{ma}$) of the measurement signals ($D_v$) for each machine position ($D_m$) in degrees, with a motion sensor (17) which has been installed between a yarn storage system (2) and a feeding device (4) detecting a yarn movement in various situations.

The bottom curve shows the moving average ($D_{ma}$) of the measurement signals ($D_v$) in the case where the tufting needle (12) is not threaded. The middle curve shows the moving average ($D_{ma}$) of the measurement signals ($D_v$) in the case where the tufting needle (12) has been threaded correctly and the top curve shows the moving average ($D_{ma}$) of the measurement signals ($D_v$) in the case of an error condition.

Again, graphs may be produced in this way for various values of the sensor sensitivity of a motion sensor (16). In each case, the moving average ($D_{ma}$) of the measurement signals ($D_v$) is plotted for this sensor sensitivity.

FIG. 9 shows that the moving average ($D_{ma}$) of the measurement signals ($D_v$) as well as the maximum and minimum value of this average at various sensor sensitivities can in this case be calculated. In this case, the following holds true:

- If the maximum value and the minimum value are similar and are close to 0, then the tufting needle (12) has not been threaded correctly with pile yarn (3).
- If the maximum value and the minimum value deviate from each other to a sufficient degree, then the tufting needle (12) is threaded correctly.
- If the maximum value and the minimum value are similar and are close to 1, then there is an error situation, such as for example a motion sensor (16) which is faulty or a pile yarn (3) which is too thick in relation to the sensor, etc.

Determining this needle cycle for various motion sensors (16), placed between the feeding device (4) and the tufting needle (12), also provides information about a correct adjustment of the needle movement. Since all tufting needles (12) make the same reciprocal movement, measuring the needle cycle may in this case be enhanced by combining simultaneously measured data from various tufting needles (12). To this end, a statistical distribution is then produced of the measurement signals ($D_v$) of several motion sensors (16).

In a tufting machine (1) in which a sliding needle bar is used, the angle of the pile yarn (3) with respect to a motion sensor (16), which has been placed between the feeding device (4) and the tufting needle (12), varies according to the position of the needle bar (14). For example, where the pile yarn (3) makes contact with the motion sensor (16), the yarn friction in this motion sensor (16) will change on the basis of the angle which the pile yarn (3) makes with respect to this motion sensor (16). The sensor sensitivity is preferably adjusted on the basis of needle bar position data in order to take into account the angle which the pile yarn (3) makes in the motion sensor (16). These needle bar position data may be determined, for example, on the basis of the pile pattern.

Figure 10:
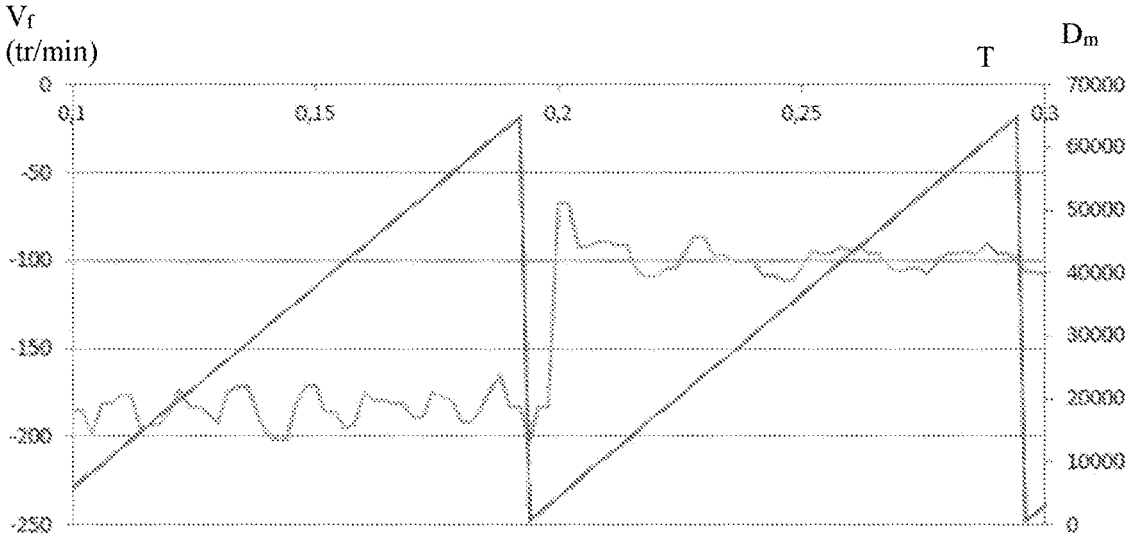
FIG. 10 shows, in a graph on the basis of time, both the machine position data and the supply motor speed.

In order to adjust the sensor sensitivity for each motion sensor (16, 17) depending on the pile delivery in a machine cycle (M), this sensor sensitivity may be adjusted, for example, on the basis of the feeding motor speed ($V_f$) of a feeding motor with variable feeding motor speed by means of which the respective pile yarn (3) is supplied in the tufting machine (1). In this case, FIG. 10 illustrates an example of a changing feeding motor speed ($V_f$) in revolutions per minute, on the basis of the time (T), in addition to the machine positions ($D_m$) which vary between 0 and 65535 or $2^{16}-1$ increments, with $2^{16}$ increments corresponding to 360°.

In existing tufting machines (1), the sensor sensitivity is optimized for an operating speed of the tufting machine (1). At other machine speeds, only a very limited number of detections are possible. By adjusting the sensor sensitivity on the basis of the machine speed (revolutions per minute), more accurate detections at different machine speeds become possible. In order to adjust the sensor sensitivity on the basis of this machine speed, the optimum sensor sensitivity may be determined at 2 or more machine speeds in an above-described learning cycle. Via interpolation, sensor sensitivities to be set for other machine speeds can then be determined. If the tufting machine (1) accelerates or decelerates, the sensor sensitivity may in this case also be adjusted on the basis of this acceleration or this deceleration of the machine speed. Thus, errors can be detected as early as possible under all circumstances.

In case of an undesired increase in the yarn tension of a pile yarn (3), a corresponding motion sensor (16) which is arranged between the feeding device (4) and the tufting needle (12) will give an active signal across a wider zone of the machine positions ($D_m$). This zone becomes wider as the yarn tension increases due to the increasing friction of the pile yarn in the sensor. Ultimately, the motion sensor (16) will give a signal at machine positions ($D_m$) where no movement is expected due to the continuous friction of the pile yarn (3). By detecting whether a motion sensor (16) indicates a certain pile yarn consumption in zones where no movement is expected, such undesired increases in the yarn tension can be detected (TED detection).

Thus, it is for example possible, when processing the pile yarn (3) for each machine cycle (M), to determine that there is a zone without movement of the pile yarn (3). The measurement signals ($D_v$) in these zones can be evaluated and an error signal can be generated if the measurement signals ($D_v$) indicate a specific pile yarn consumption during a monitoring time.

If use is made of optical sensors instead of piezoelectric sensors and an undesired increase in the yarn tension of a pile yarn (3) occurs, the corresponding motion sensor (16) which is arranged between the feeding device (4) and the tufting needle (12) will detect less movement. Ultimately, the motion sensor indicates a greatly reduced movement in zones where movement is expected. As a result thereof, such undesired increases in the yarn tension can be detected (TED detection).

Figure 12:
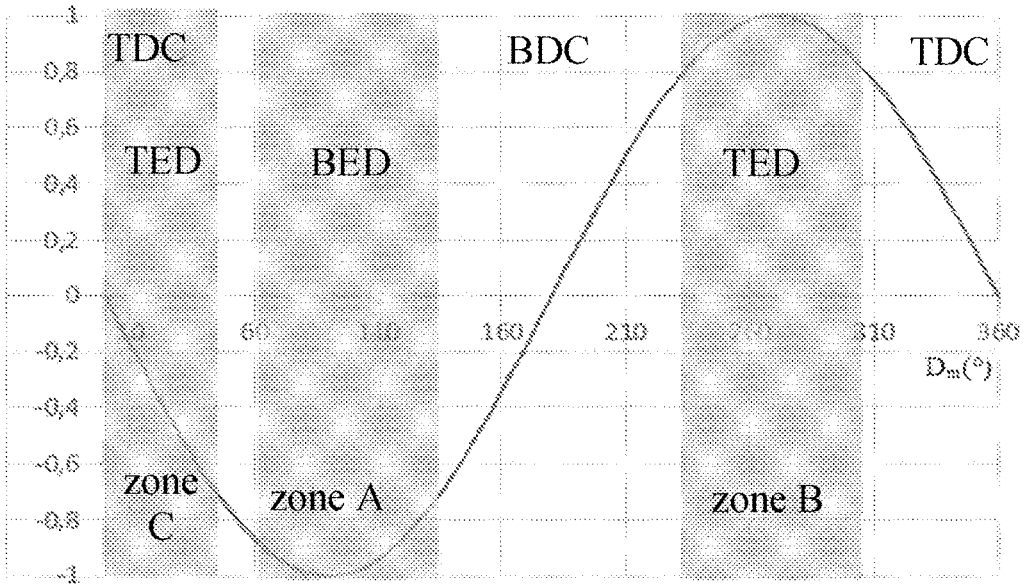
FIG. 12 shows, in a graph, the movement of the tufting needle in a machine cycle on the basis of the needle position, with three zones of detection being indicated.

At the start of a machine cycle (M), the motion sensor (16) may be set to the same sensor sensitivity as a sensor sensitivity for detection of yarn breakage. In this way, a zone in which any increased yarn tension is being monitored can adjoin or coincide with a zone in which possible yarn breakage is being monitored, as can be seen in FIG. 12, where zone C just precedes zone A. Alternatively, a specific zone may be determined further along in a machine cycle (M) in which only a possible increased yarn tension is being monitored. In FIG. 12, this is zone B. The sensor sensitivity in this specific zone can then be set separately for this predetermined detection.

The invention claimed is:

1. A method for monitoring the tension of a pile yarn in a tufting machine which is provided with several tufting needles and assumes cyclically successive machine positions during various machine cycles, wherein this pile yarn is incorporated in a fabric in the machine cycles by a tufting needle which is positioned in various needle positions at a respective distance from the fabric by positioning the tufting machine in the machine positions during each machine cycle, the method comprising:

generating, by a motion sensor, measurement signals ($D_v$) that are an indication of the pile yarn consumption of this pile yarn;

determining machine position data ($D_m$) that are an indication of one or more machine positions per machine cycle; and evaluating, within each machine cycle, the measurement signals ($D_v$) on the basis of the machine position data ($D_m$), thereby monitoring the tension of the pile yarn in the tufting machine, and determining an error exists based on the evaluated measurement signals ($D_v$).

2. The method according to claim 1, wherein the pile yarn is incorporated in the fabric according to a pile pattern, in that this pile pattern is forwarded in the tufting machine at least one fixed moment per machine cycle, and wherein the machine position data ($D_m$) are at least partly determined by means of the moment the pile pattern was forwarded.

3. The method according to claim 2, wherein it is determined, on the basis of the pile pattern, at which pile height the pile yarn is incorporated in the fabric, and in that the measurement signals ($D_v$) are evaluated on the basis of this pile height.

4. The method according to claim 1, wherein the tufting needle for each machine cycle is selectable to be positioned in various needle positions, optionally in accordance with the various machine positions, in that needle selection data are determined which indicate for each machine cycle whether the tufting needle has or has not been selected to be positioned in various needle positions by the various machine positions, and in that the measurement signals ($D_v$) are evaluated on the basis of these needle selection data.

5. The method according to claim 1 wherein the measurement signals ($D_v$) for each machine cycle are evaluated on the basis of the machine position data ($D_m$) in at least two modes.

6. The method according to claim 1, wherein a statistical distribution ($D_s$) of measurement signals ($D_v$) per machine position is determined on the basis of these measurement signals ($D_v$) over several machine cycles.

7. The method according to claim 1, wherein the measurement signals ($D_v$) are generated by the motion sensor, wherein the motion sensor is an optical sensor.

8. The method according to claim 1, wherein the measurement signals ($D_v$) are generated by the motion sensor, wherein the motion sensor is a piezoelectric sensor.

9. The method according to claim 1, wherein the measurement signals ($D_v$) are generated at a specific sensor sensitivity, this sensor sensitivity being adjustable.

10. The method according to claim 6, wherein the measurement signals ($D_v$) are generated at a specific sensor sensitivity, this sensor sensitivity being adjustable, and wherein the tufting needle for each machine cycle is positioned in the various machine positions according to a typical needle movement, and in that, in order to determine the specific sensor sensitivity, the sensor sensitivity is adjusted in a learning cycle over various machine cycles until the specific statistical distribution ($D_s$) virtually corresponds to the typical needle movement.

11. The method according to claim 10, wherein, if, after the learning cycle, the specific statistical distribution ($D_s$) deviates from the typical needle movement, above a first set limit value or below a second set limit value, the specific sensor sensitivity is adjusted accordingly until the specific statistical distribution ($D_s$) again virtually corresponds to the typical needle movement.

12. The method according to claim 4, wherein the measurement signals ($D_v$) are generated at a specific sensor sensitivity, this sensor sensitivity being adjustable, and wherein the sensor sensitivity is adjusted on the basis of the needle selection data.

13. The method according to claim 4, wherein the measurement signals ($D_v$) are generated at a specific sensor sensitivity, this sensor sensitivity being adjustable, and wherein the tufting machine comprises a sliding needle bar, wherein needle bar position data are determined, and in wherein the sensor sensitivity is adjusted based on the needle bar position data.

14. The method according to claim 3, wherein the measurement signals ($D_v$) are generated at a specific sensor sensitivity, this sensor sensitivity being adjustable, and wherein the sensor sensitivity is adjusted on the basis of the pile height.

15. The method according to claim 3, wherein the measurement signals ($D_v$) are generated at a specific sensor sensitivity, this sensor sensitivity being adjustable, and wherein the pile yarn in the tufting machine is supplied by a feeding motor with a variable feeding motor speed ($V_f$), and wherein the sensor sensitivity is adjusted on the basis of this feeding motor speed ($V_f$).

16. The method according to claim 9, wherein the tufting machine (1) is driven at a variable machine speed, and wherein the sensor sensitivity is adjusted on the basis of the machine speed.

17. The method according to claim 16, wherein the tufting machine is controlled by an acceleration or a deceleration of the machine speed, and wherein the sensor sensitivity is adjusted on the basis of the acceleration or the deceleration of the machine speed.

18. The method according to claim 1, wherein during processing of the pile yarn for each machine cycle there is at least a zone of machine positions in which there is no pile yarn consumption, and wherein the measurement signals ($D_v$) in this zone are evaluated and an error signal is generated if the measurement signals ($D_v$) indicate a certain pile yarn consumption during a monitoring time.

19. The method according to claim 18, wherein the measurement signals ($D_v$) are generated at a specific sensor sensitivity, this sensor sensitivity being adjustable, and wherein the sensor sensitivity is adjusted in accordance with the zones.

20. The method according to claim 1, wherein the pile yarn consumption of the pile yarn is measured by the motion sensor between a feeding device for supplying the pile yarn in the tufting machine and the tufting needle.

21. The method according to claim 1, wherein a moving average ($D_{ma}$) of the measurement signals ($D_v$) is determined over a specific number of machine cycles, and it is determined whether this moving average ($D_{ma}$) exceeds a limit value.

22. The method according to claim 1, wherein the tension of one or more additional pile yarns is monitored by one or more corresponding additional motion sensors to generate corresponding additional measurement signals ($D_v$) and to evaluate these additional measurement signals ($D_v$) on the basis of the machine position data ($D_m$).

23. The method according to claim 6, wherein a statistical distribution of the measurement signals ($D_v$) of several motion sensors is determined.

24. A monitoring system for monitoring the tension of a pile yarn in a tufting machine which is provided with several tufting needles and assumes cyclically successive machine positions in various machine cycles, wherein this pile yarn is incorporated in a fabric in the machine cycles by a tufting needle which is positioned in various needle positions at a respective distance from the fabric by positioning the tufting machine in the machine positions during each machine cycle, comprising:

a unit for determining machine position data ($D_m$) that indicate one or more machine positions per machine cycle, a motion sensor for generating measurement signals ($D_v$) that indicate pile yarn consumption of this pile yarn, and an evaluation system for evaluating, within each machine cycle, the measurement signals ($D_v$) on the basis of the machine position data ($D_m$), thereby monitoring the tension of the pile yarn in the tufting machine, to determine if an error exists.

25. A tufting machine, comprising a monitoring system according to claim 24.

26. A method for monitoring the tension of a pile yarn in a tufting machine which is provided with several tufting needles and assumes cyclically successive machine positions during various machine cycles, wherein this pile yarn is incorporated in a fabric in the machine cycles by a tufting needle which is positioned in various needle positions at a respective distance from the fabric by positioning the tufting machine in the machine positions during each machine cycle, the method comprising:

generating, by a motion sensor, measurement signals ($D_v$) that are an indication of the pile yarn consumption of this pile yarn;

determining machine position data ($D_m$) that are an indication of one or more machine positions per machine cycle; and evaluating, within one machine cycle in the various machine cycles, the measurement signals ($D_v$) on the basis of the machine position data ($D_m$) to analyze behavior of yarn movement of the pile yarn within the one machine cycle, thereby monitoring the tension of the pile yarn in the tufting machine.

27. A monitoring system for monitoring the tension of a pile yarn in a tufting machine which is provided with several tufting needles and assumes cyclically successive machine positions in various machine cycles, wherein this pile yarn is incorporated in a fabric in the machine cycles by a tufting needle which is positioned in various needle positions at a respective distance from the fabric by positioning the tufting machine in the machine positions during each machine cycle, comprising:

a unit for determining machine position data ($D_m$) that indicate one or more machine positions per machine cycle, a motion sensor for generating measurement signals ($D_v$) that indicate pile yarn consumption of this pile yarn, and an evaluation system for evaluating, within one machine cycle in the various machine cycles, the measurement signals ($D_v$) on the basis of the machine position data ($D_m$) to analyze behavior of yarn movement of the pile yarn within the one machine cycle, thereby monitoring the tension of the pile yarn in the tufting machine.

* * * * *